US005284251A

United States Patent [19]

Marrs et al.

[11] Patent Number: 5,284,251

[45] Date of Patent: Feb. 8, 1994

[54] TENSION BAR SCREEN

[75] Inventors: Gevan R. Marrs, Puyallup, Wash.; Karl B. Werginz, Dunwoody, Ga.

[73] Assignee: Weyerhaeuser Co., Tacoma, Wash.

[21] Appl. No.: 918,645

[22] Filed: Jul. 21, 1992

[51] Int. Cl.[5] ..... B07B 1/49

[52] U.S. Cl. ..... 209/396; 209/674

[58] Field of Search ..... 209/674, 660, 325, 326, 209/393, 396, 365.2, 394, 395

[56] References Cited

U.S. PATENT DOCUMENTS 3,106,524 10/1963 Wolfe et al. ..... 209/396

5,117,983 6/1992 Marrs ..... 209/396

FOREIGN PATENT DOCUMENTS 264867 2/1989 Fed. Rep. of Germany ..... 209/393

*Primary Examiner*—D. Glenn Dayoan

*Assistant Examiner*—Kenneth Noland

*Attorney, Agent, or Firm*—Jensen & Puntigam

[57] ABSTRACT

A bar screen apparatus (10) having inner and outer frame assemblies (14, 16), with each frame assembly including a plurality of thin, blade-like bar elements (44). Each frame assembly (14, 16) further includes means for maintaining the blade-like bar elements under tension (58, 76). The inner and outer frame assemblies are driven by a drive system which includes a drive motor (97), a first drive shaft (121) at the infeed end of the apparatus, a second drive shaft (128) at the discharge end of the apparatus and a connecting assembly (126) for connecting the two drive shafts. Certain eccentric cams (114, 116, 118 and 120) are mounted on the first drive shaft (121) and are connected to the inner and outer frame assemblies (14, 16), while other eccentric cams (140, 142, 144 and 146) are mounted on the second drive shaft (128) and are connected to the inner and outer frame assemblies (14, 16), with the bar elements in the inner frame assembly being driven approximately 180° out of phase relative to the bar elements in the outer frame assembly.

15 Claims, 3 Drawing Sheets

TENSION BAR SCREEN

TECHNICAL FIELD

This invention relates generally to the field of screening apparatus for sorting wood chips and similar articles, and more particularly concerns a particular type of bar screen.

BACKGROUND OF THE INVENTION

In a typical bar screen apparatus for wood chips, with a length on the order of 10 feet, there often arises a problem of maintaining adequate bar rigidity, i.e. stiffness, over the entire length of the bars. Without sufficient stiffness, the bars deflect to an extent, particularly near mid-length, such that the size of the screen openings will vary over the length of the screen, degrading performance and predictability of results. To correct this, the bars comprising the screen typically have a fairly large thickness, so that the percentage of the screen area that is open to passage of acceptable-size material is only approximately 35%. Alternatively, the individual bars can be supported in some fashion at various points along the lengths thereof. These intermediate support elements can interfere, however, with the passage of acceptable-size material.

In addition to the above-described undesirable deflection effect which occurs over the length of the bars, there is often difficulty in obtaining adequately straight bars from a manufacturer, i.e. the bars are often slightly bowed or crooked. Bars having the required straightness are initially expensive, and also are expensive to replace. In general, such bar screens are expensive to maintain.

DISCLOSURE OF THE INVENTION

Accordingly, the invention is a wood chip screen system using bar elements under tension, comprising a first screen assembly which includes a first set of relatively thin, blade-like bar elements; a second screen assembly which includes a second set of relatively thin, blade-like bar elements, wherein the first and second screen assemblies are arranged such that bar elements in the first set are interleaved with bar elements in the second set; means for placing the bar elements in the first and second sets under sufficient tension to maintain rigidity of the bar elements over their entire length so that they function as a bar screen; and means for driving the bar elements in the first and second sets thereof in such a manner that they move both longitudinally and vertically in a predetermined path, resulting in acceptable size wood chips falling therethrough and oversize wood chips moving to an outfeed end of the screen apparatus.

BEST MODE FOR CARRYING OUT THE INVENTION

Generally, the present invention is a bar screen apparatus for sorting wood chips according to dimension. In the preferred form, the apparatus comprises two sets of interleaved, elongated bars. The respective sets of interleaved bars are supported, respectively, by first and second frame systems. The bar screen apparatus includes a drive system which in turn includes a motor at the infeed end of the bar screen apparatus, with the motor driving control cams which are in turn connected to the first and second frame systems, to provide the required screen movement. One significant aspect of the bar screen apparatus concerns the bars themselves, which in the embodiment shown are thin, blade-like bar elements which are placed under tension at the opposite ends thereof to maintain the required bar rigidity and stiffness over the entire length of the screen while at the same time maintaining a large percentage of the total screen area open for passage of acceptable-size material. Such blade-like bar elements are thus advantageous over the conventional bars.

Figure 1:
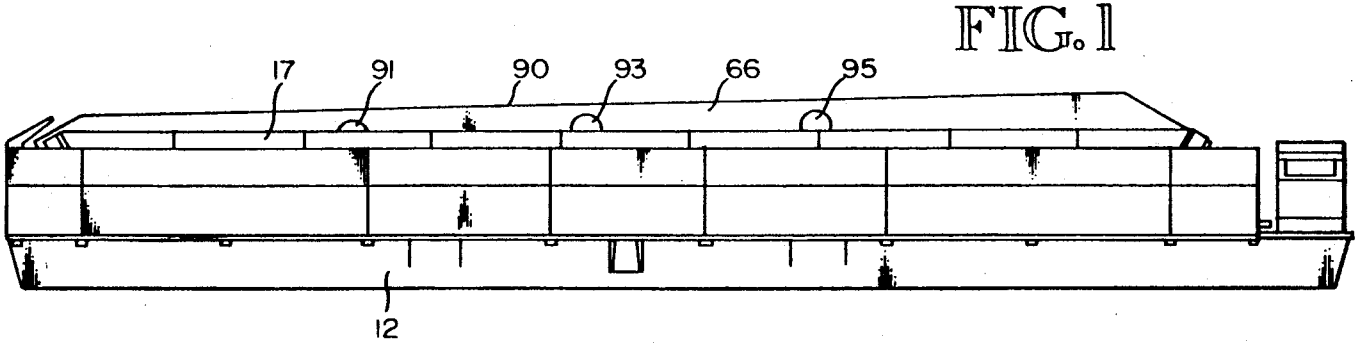
FIG. 1 is a side elevation view of the tension bar screen apparatus of the present invention.
Figure 2:
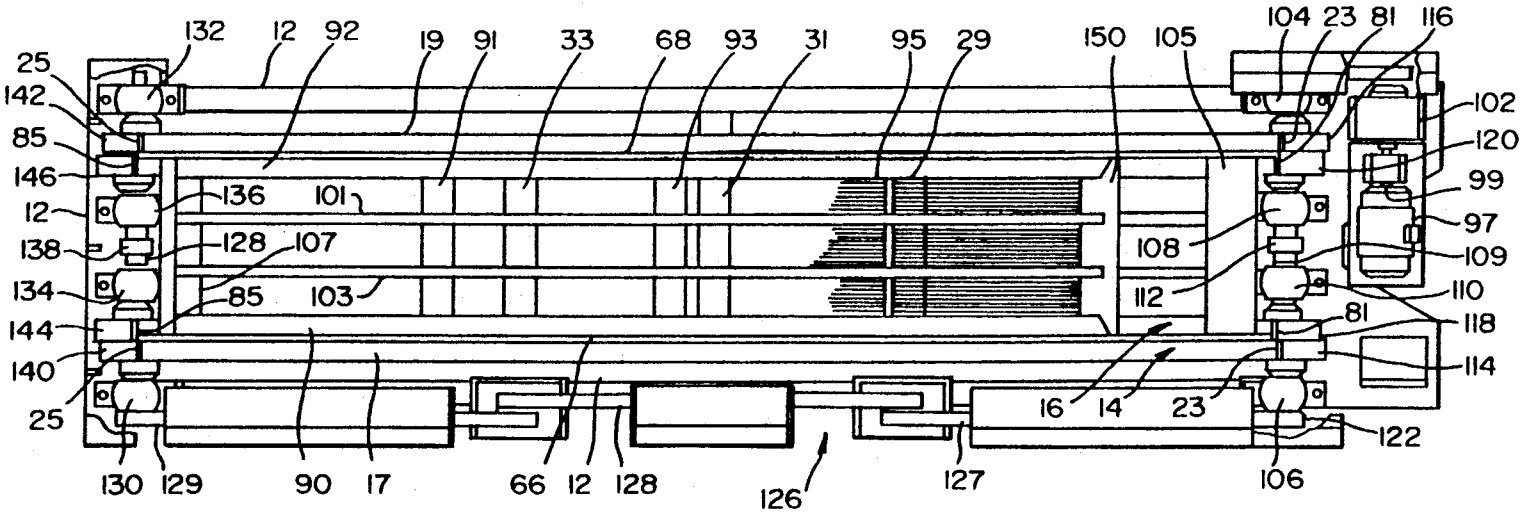
FIG. 2 is a partial top view of the bar screen apparatus of FIG. 1.

FIGS. 1 and 2 show the overall structure for the bar screen apparatus, referred to generally at 10. In the embodiment shown, the screen apparatus includes longitudinal and lateral channel members 12—12 which in combination form a base frame for the screen apparatus. In the embodiment shown, the base frame channel members 12—12 are approximately 614 8 inches square, with the longitudinal base frame channel members being approximately 16 feet long and the lateral base frame channel members being approximately 12 feet long. In the embodiment shown, there are two support frame assemblies, each of which support a plurality of elongated bar elements. The two support frame assemblies, referred to as outer and inner frame assemblies, are supported relative to each other, as described more fully hereinafter, such that the bar elements of the respective frame assemblies are interleaved and follow a similar path of movement when actuated by a driving means, although in the embodiment shown, the movement of the bar elements in the respective frame assemblies are 180° out of phase, as is conventional with bar screens using two sets of bars.

Figure 3:
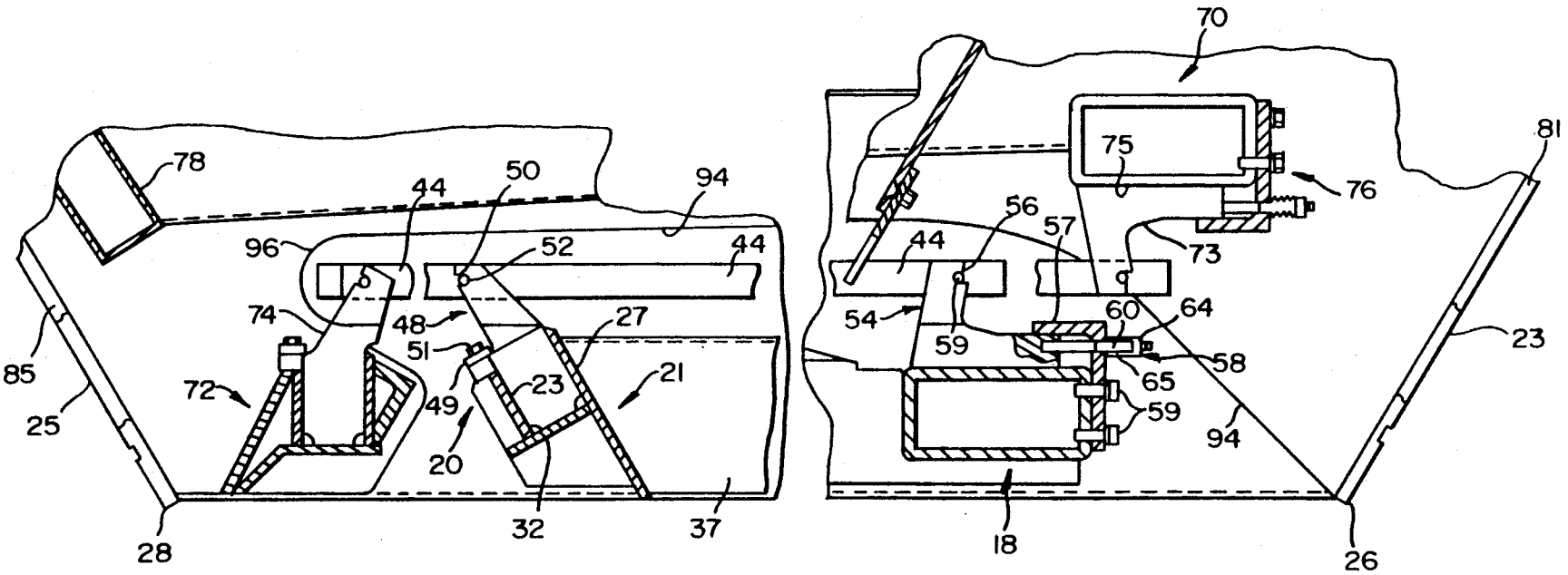
FIG. 3 are cross-sectional views showing portions of the infeed and discharge ends of the bar screen apparatus of FIG. 1.

Outer frame assembly 14 supports both ends of its bar elements from below, while inner frame assembly 16 supports one end of its bar elements from above and one end from below. Outer frame assembly 14 includes two longitudinal side channel members 17 and 19, connected by lateral support members 18 and 20, which extend laterally across the bar screen apparatus a short distance from its infeed and discharge ends, respectively. FIG. 2 does not show the lateral support elements 18, 20 for clarity, but FIG. 3 shows them in cross-section. The infeed end lateral support member 18 is a channel element, rectangular in cross-section, approximately 10 inches wide by 4 inches high in cross-section, while discharge end lateral support member 20 has a more complex cross-sectional configuration, comprising a basically T-shaped section 21, with a flange 23 extending from a base portion 32 of the T-shaped section, parallel to one-half of a top portion 27 thereof. A space of approximately 2¾ inches separates flange 23 from top portion 27.

Generally, side channel members 17 and 19 are approximately 3 inches wide by 10 inches high, with a side flange 24 extending upwardly therefrom, adding approximately 7½ inches of height. Extending between the side channel members 17 and 19 are three tubular sections 29, 31 and 33, each approximately 4 inches in diameter. Additional structural elements could be used between side channel members 17 and 19, if necessary for additional strength. Extending the entire length of the outer frame assembly 14 are a plurality of longitudinal bracing plates (not shown) through which the tubular sections 29, 31 and 33 extend. Additional longitudinal bracing plates are provided at the infeed and discharge ends of the apparatus. FIG. 3 partially shows one such additional bracing plate 37, which extends from discharge end lateral support member 20 to tubular section 33.

Figure 4:
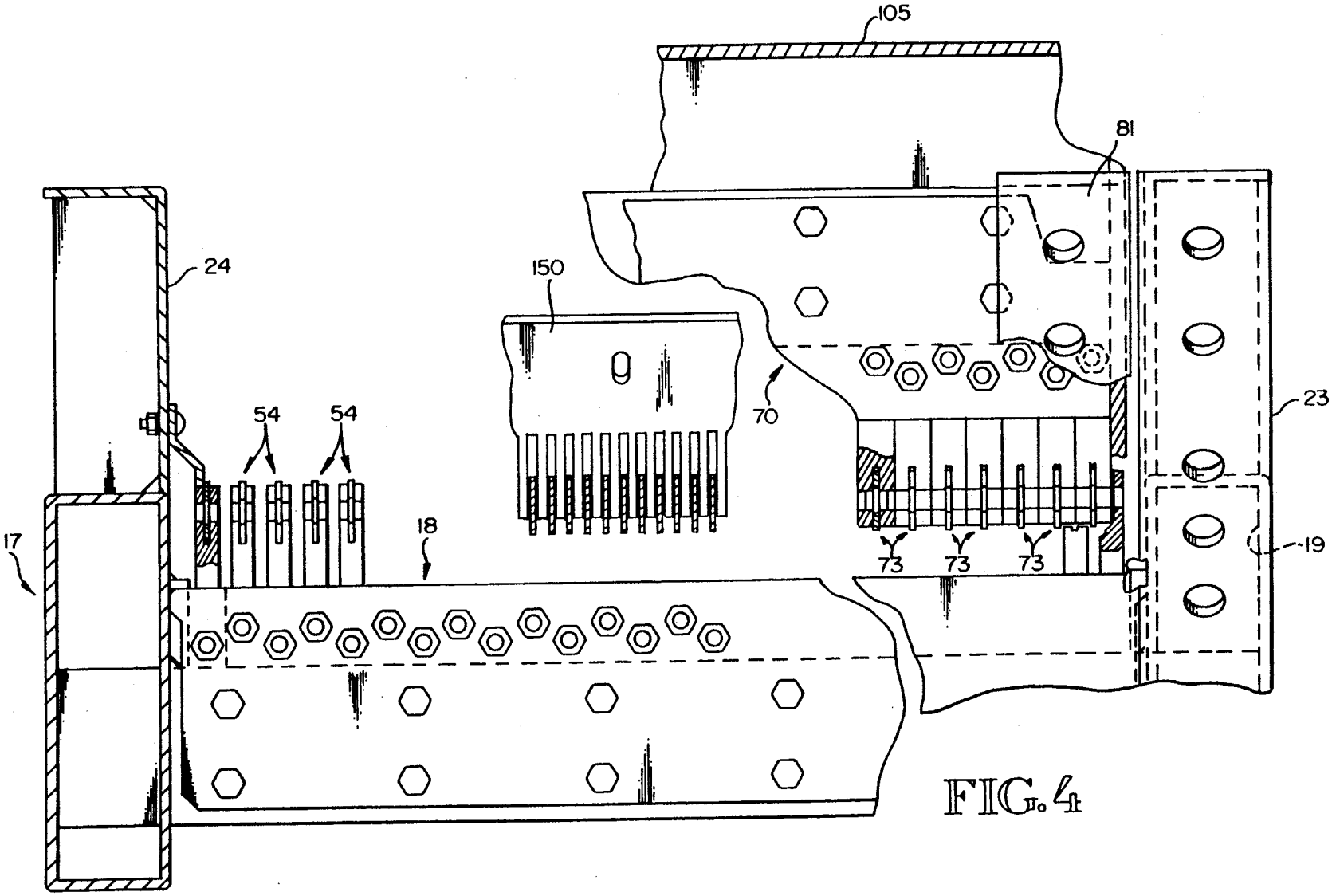
FIG. 4 is an end elevation view showing the infeed end of the bar screen apparatus of FIG. 1.

The respective ends of each side channel member, e.g. channel 19, are connected to front and rear angled flanges, e.g. flanges 23—23 and 25—25, respectively, in FIGS. 3 and 4, located on both sides of the apparatus at the infeed end and discharge ends, respectively, of the apparatus. The front flanges 23—23 angle forwardly from their lower ends 26—26 at an angle of approximately 30° from the vertical, while the rear flanges 25—25 angle rearwardly from their lower ends 28—28 at the same angle.

The elements comprising the outer frame are all made from heavy gauge steel, for strength and rigidity. For example, the side channel members and the tubular sections have walls which are approximately 5/16 inch thick.

The supports for the bar elements on the lateral support members 18, 20 are shown in FIG. 3. As indicated above, the bar elements of the screen system of the present invention are more accurately characterized as blades and will be referred to as blades hereinafter. Typically, blades 44 extend almost the full length of the apparatus, and therefore will be approximately 10 feet long in the screening apparatus of the present invention. In the embodiment shown, blades 44 are typically made from high-strength steel, have a thickness within the range of 1.5–3.5 mm, and a height within the range of 1½ to 2 inches.

Referring to FIG. 3, and in particular to discharge end lateral support member 20, there is located at the discharge end of each blade 44 a small hole. A plurality of blade support elements 48 are mounted on the discharge end lateral support member 20 (between flange 73 and portion 27 of T-shaped section 21), extending upwardly and somewhat rearwardly therefrom. A horizontal slot 50 is provided in the upper rear edge of blade support element 48, extending forwardly (toward the infeed end) a small distance. The plurality of blade support elements 48 are mounted at spaced intervals along the discharge end lateral support member 20. The blade support elements are held in place by a clamping bar 49 and cap screw 51. A lock pin 52 is positioned through the opening in each blade 44 and through slot 50 in each support element. This simple arrangement locks the blades firmly in place relative to the discharge end lateral support member 20. In a typical apparatus, outer frame assembly 14 includes approximately 160 blades, thus requiring 160 blade support elements spaced along the length of discharge end lateral support member 20. It should be understood that the apparatus shown in FIG. 2 is for illustration only. Typically, the apparatus will be wider than that shown; i.e. a typical screen will be 10 feet long and 10 feet wide.

Referring still to FIG. 3, there is also a blade support element 54 for each blade in the outer frame assembly on the upper surface of infeed end lateral support channel member 18, extending upwardly therefrom. Each blade support element 54 includes a horizontal slot 56, to accommodate a lock pin 59, the slot 56 extending toward the discharge end of the apparatus, near the top of the blade support element. Each blade 44 includes a small opening at the infeed end thereof through which the lock pin 59 extends for mounting blades 44—44 to the blade support elements 54—54. The blade support elements are mounted to lateral support member 18 by means of a flange 57, which is secured to the lateral support member 18 by cap screws or the like.

Tensioning assemblies 58—58 are mounted on flange 57 to secure the blade support elements to the lateral support member 18. Each tensioning assembly 58 includes an elongated, horizontal threaded member 60, one end of which is secured to its associated blade support element 54. Threaded member 60 extends through flange 57, and has a lock nut 64 on the exposed end thereof. As the lock nut 64 is rotated in one direction, the blade support element 54 associated therewith is slowly drawn toward the infeed end of the apparatus, thereby gradually increasing the tension on the blade. When the threaded element is turned in the other direction, tension decreases. Tensioning assembly 58 also includes a shock-absorbing element 65, such as a disc spring or spring washer, which permits a momentary deflection of the blade without a permanent elongation.

In operation, a particular blade support element 54 on lateral support member 18 is first moved to a position relatively toward the discharge end of the apparatus. The rear end of blade 44 is mounted on a given blade support element 48 present on the discharge end lateral support member 20 by lock pin 52. The forward end of blade 44 is then mounted on blade support element 54 present on the infeed end lateral support member 18 by lock pin 59. The lock nut 64 on threaded tension member 60 is then rotated sufficiently to produce the desired tension on the blade by drawing support element 54 toward the infeed end of the apparatus. In the embodiment shown, the desired tension on the blades is accomplished by applying 60–100 ft/lbs of torque to the lock nuts, producing 600–1000 lbs of load on each blade. In one specific example, 70 ft/lbs of torque will produce a load of 800 lbs. This tension will result in maintaining the mid-span deflection of the blades to a desired minimum (1 millimeter deflection for 10 lbs of lateral force). The required rigidity of the blades is thus obtained and the blades are sufficiently straight for proper operation.

In the outer frame assembly 14, blades 44 are supported from below at both ends thereof, while in the inner frame assembly 16, the blades are supported from above at the infeed end of the apparatus and from below at the discharge end. Inner frame assembly 16 has a different configuration from the outer frame. It includes two longitudinal side walls 66 and 68 and lateral support members 70 and 72 which extend for the full width of the inner frame assembly portion of the screening apparatus. The side walls 66 and 68 are positioned slightly inboard of the outer frame longitudinal channel members 17 and 19.

Infeed end lateral support member 70, in the form of a channel, is similar in configuration and orientation to infeed end lateral support channel 18, although channel member 70 is located slightly nearer the infeed end of the apparatus and approximately 6 inches thereabove as shown most clearly in FIG. 3. A plurality of blade support members 73 extend downwardly from a lower surface 75 of lateral support member 70. The discharge end lateral support member 72 has a rather complex cross-sectional configuration, and is located a short distance downstream from the discharge end lateral support member 20 for the outer frame assembly. Discharge end lateral support member 72 has mounted thereon a plurality of spaced blade support members 74. A plurality of tensioning assemblies 76—76, similar to those for lateral support member 18 but extending downwardly from lateral support member 70, control the position of blade support members 73, and hence the tension on the blades.

The result of this arrangement is that the two sets of blades, one set in the outer frame and the other set in the inner frame, move in the same path, although they are offset laterally, and are 180 apart in their respective movements. The blades in the inner frame are similar to the blades in the outer frame, except that the inner frame blades are slightly longer, to accommodate the greater distance between their two lateral support members 70 and 72.

The inner frame 16 includes another lateral support member 78 which has a channel configuration, located approximately in the same horizontal plane as infeed end lateral support member 70 but downstream therefrom and from lateral support member 72. Lateral support member 78 extends between side walls 66 and 68, like lateral support members 70 and 72.

At the front angled edge of side walls 66 and 60 are connected two forwardly angled flanges 81—81, while connected to the rear angled edges thereof are rearwardly angled flanges 85—85. The front flanges 81—81 angle forwardly at an angle of approximately 30° from the vertical, like the flanges for the outer frame. The inner and outer frame front flanges are in the same plane, as shown in FIG. 3. The front flanges 81—81, at the infeed end of the inner frame, like front flanges 23—23 of the outer frame, are both approximately 21 inches long and 3½ inches wide. Rear flanges 85—85 of the inner frame at the discharge end of the apparatus are similar in size and configuration to front flanges 81—81 thereof (and to rear flanges 25—25 for the outer frame), but are angled rearwardly. The rear flanges 85—85 of the inner frame are in the same plane as the rear flanges of the outer frame.

The top longitudinal edges 90, 92 of the two side walls 66 and 68 of the inner frame extend in a flat line between the top edges of the front and rear flanges connected to each side wall. The lower edge of each side wall, however, referring as an example to edge 94 of side wall 68 in FIG. 3, extends upwardly from the infeed end of the side wall and toward the discharge end of the apparatus at an angle of approximately 45°, for a distance of approximately 8 inches, at which point edge 94 gradually curves until it becomes horizontal, and then extends rearwardly until the vicinity of lateral support member 72, where it curves back toward the infeed end of the apparatus in a semicircular portion 96. It then angles downwardly but still toward the infeed end of the apparatus for a short distance, and then angles toward the discharge end of the apparatus and finally downwardly to a point from where it extends directly rearwardly to the rear edge of the wall, at the discharge end of the apparatus.

Providing reinforcement for the inner frame are a plurality of tubular cross-support elements 91, 93 and 95, which extend between the side walls 66, 68 and define openings in the side walls, as shown in FIG. 1. The three tubular cross-support elements 91, 93 and 95 are shown at particular spaced intervals along the length of the inner frame, although the number and spacing may vary. Extending approximately the full length of the apparatus are two longitudinal bracing plates 101 and 103, as shown in FIG. 2. The full length bracing plates for the outer frame in the embodiment shown are hidden by plates 101 and 103. Additional longitudinal bracing plates will be present for a full width (10 ft) apparatus. Still further, a front bracing member 105 extends between the side walls 66, 68 at the infeed end of the apparatus, while a rear bracing member 107 extends between the side walls 66, 68 at the discharge end of the apparatus.

The drive system for the bar screen apparatus is shown most clearly in FIG. 2. In this particular embodiment, the drive system includes a single drive motor 97 which directly drives a horizontal drive shaft 99. The drive shaft extends through a gear reducer 102 which drives a belt, which is connected to one end of a primary drive shaft 109, which is supported on either side of the apparatus at the infeed end thereof by outer bearings 104, 106. Two inner bearings 108,110 and a central coupling 112 complete the primary drive support system.

The primary drive shaft drives two outer eccentrics 114 and 116, which are connected to the two front flanges 23—23 of the outer frame, and also drives two inner eccentrics 118, 120, which are connected to the front flanges 81—81 of the inner frame. The other end 122 of the primary drive shaft has a toothed pulley thereon, which drives a longitudinal drive belt assembly shown generally at 126. Drive belt assembly 126 extends the length of the apparatus, and comprises three toothed drive belt sections 127, 128 and 129, each section being connected to its adjacent section by a lateral shaft on which are positioned two toothed pulleys side by side.

At the rear of the apparatus is a secondary drive shaft 128, which is supported by outer bearings 130, 132, inner bearings 134, 136 and central coupler 138. Secondary drive shaft 128 drives outer eccentric cams 140, 142, which are connected to the rear flanges 25—25 of outer frame 14, and also drives inner eccentric cams 144, 146, which are connected to the rear flanges 85—85 of inner frame 16.

The eccentric cams are mounted on the primary and secondary drive shafts in such a manner that rotation of the drive shafts drive the cams in a particular motion which in turn results in the outer and inner frames moving such that the blades move both laterally and vertically approximately 1 inch, i.e. each point on the blades, such as the ends, moves in a circle approximately 1 inch in diameter, and such that the outer frame and the inner frame are driven 180° apart.

In operation of the apparatus, wood chips are loaded at the infeed end of the apparatus shown in FIG. 1. The drive motor 97 is started, and the inner and outer frames, with the plurality of blades mounted thereon, begin to move. The blades, because of the configuration of the eccentric cams, move in a vertical and longitudinal path, as explained above, supported at the opposite ends thereof. One or more comb elements, such as shown at 150 in FIGS. 2 and 4, are mounted to extend downwardly into the plurality of blades, maintaining spacing and position of the blades at the infeed end thereof. Additional comb elements extend upwardly from beneath the blades into the plurality of blades.

The two sets of blades in the outer and inner frames, respectively, are driven 180° out of phase with each other; hence, the two frames and their associated sets of blades are always in opposing positions in their respective paths of movement; i.e., one set of blades will be in an "up" position while the other set will be "down" and vice versa. Proper tension on the bar elements can be readily maintained by adjustment of the tensioning means on the individual bar support elements.

The above-described arrangement has a number of significant advantages over existing bar screens. First, the use of blades, with the required stiffness and rigidity being maintained by tensioning both ends of the blades, is significantly less expensive than the use of conventional bar elements. Further, the blades, being held in tension, can be easily and inexpensively removed and replaced.

Another significant advantage of the arrangement of the present invention is that the percentage of open area of the screen increases dramatically with the use of blades. Instead of a conventional value of approximately 35%, the screen of the present invention has a percentage of open area of 50% in some cases and in others up to 85%. This increases the efficiency and operation of the bar screen system.

Although a preferred embodiment of the invention has been described for purposes of illustration, it should be understood that various modifications and substitutions may be incorporated therein, without departing from the spirit of the invention, which is defined by the claims that follow:

What is claimed is:

1. A wood chip screen system using bar elements under tension, comprising:

a first screen assembly which includes a first set of relatively thin, blade-like bar elements; a second screen assembly which includes a second set of relatively thin blade-like bar elements, wherein the first and second screen assemblies are arranged such that bar elements in the first set thereof are interleaved with bar elements in the second set thereof;

means for placing the bar elements in said first and second sets thereof under sufficient constant longitudinal tension during operation of the apparatus to maintain rigidity and relative spacing of the bar elements over their entire lengths; and means for driving the bar elements in the first and second sets thereof in such a manner that they move both longitudinally and vertically in a predetermined path, resulting in acceptable size wood chips falling therethrough and oversize wood chips moving to an outfeed end of the screen apparatus.

2. An apparatus of claim 1, wherein each bar element in the first and second sets thereof has a separate tensioning member associated therewith, the tensioning member including means for selectively changing the tension on its associated bar element.

3. An apparatus of claim 1, wherein the tension means are located at opposing ends of the bar elements in the first and second sets thereof.

4. An apparatus of claim 1, wherein the bar elements have a width which is substantially greater than the thickness thereof.

5. An apparatus of claim 1, wherein the screen system has a percentage of open area of approximately at least 50%.

6. An apparatus of claim 5, wherein the percentage of open area is approximately 85%.

7. An apparatus of claim 1, wherein the first screen assembly includes an outer frame assembly in which the first set of bars are positioned and supported move therewith, and wherein the second screen assembly includes an inner frame assembly in which the second set of bars are positioned and supported and move therewith, wherein the apparatus includes means for supporting said first and second frames for back and forth reciprocating action, and wherein said driving means is connected to the inner and outer frame assemblies and in operation moves the inner and outer frame assemblies so that the first and second sets of bar elements, respectively, move in said predetermined path.

8. An apparatus of claim 7, wherein the driving means includes a first drive shaft positioned across and adjacent to an infeed end of the screen system and first eccentric cam elements mounted on the first drive shaft, the first eccentric cam elements being connected to the inner and outer frame assemblies and are so configured that when the first drive shaft is rotated, the first and second sets of bar elements, respectively, move in said predetermined path.

9. An apparatus of claim 8, wherein the driving means includes a second drive shaft extending across and adjacent to a discharge end of the screen system and second eccentric cam elements mounted on the second drive shaft, the second eccentric cam elements being connected to the inner and outer frame assemblies, the apparatus further including means for connecting said first drive shaft and said second drive shaft, such that operation of the first drive shaft results in movement of the second drive shaft therewith.

10. An apparatus of claim 9, wherein the driving means further includes a single motor for driving the first drive shaft.

11. An apparatus of claim 9, wherein the outer frame assembly includes two longitudinal support members and first and second lateral support members, the first and second lateral support members being located relatively toward the infeed and discharge ends of the apparatus, respectively, and including a plurality of bar element mounting elements extending upwardly therefrom for mounting opposing ends of the first set of bar elements.

12. An apparatus of claim 11, wherein said bar element mounting elements on the second lateral support member each include means for attaching a rear end of a bar element thereto and wherein each of the bar element mounting elements on the first lateral support member includes means for attaching a front end of a bar element thereto, and wherein the first lateral support member includes a plurality of tensioning members, each tensioning member being associated with a particular bar element mounting element, mounted so as to longitudinally move the particular bar element mounting element, thereby increasing or decreasing tension on the bar element supported by the particular bar element mounting element.

13. An apparatus of claim 11, including flange plates connected to opposing ends of each longitudinal member, wherein the flange plates at the infeed end of the apparatus angle forwardly of the apparatus and wherein the flange plates at the discharge end of the apparatus angle rearwardly of the apparatus, and wherein two of the eccentric cams on each of said first and second drive shafts are connected to the flange plates, respectively.

14. An apparatus of claim 11, wherein the inner frame assembly includes two side walls positioned slightly inboard of the longitudinal support members of the outer frame assembly and are configured so as to clear the first and second lateral support members of the outer frame assembly, the inner frame assembly including first and second lateral support members which extend between the two side walls, the first lateral support member of the inner frame assembly being located in the vicinity of the infeed end of the apparatus but somewhat above and forwardly of the first lateral support element of the outer frame assembly, the second lateral support member of the inner frame assembly being located rearwardly of the second lateral support member of the outer frame assembly, the first and second lateral support members of the inner frame assembly further including a plurality of bar element mounting elements, wherein the bar element mounting elements extend upwardly from the second lateral support member of the inner frame assembly and downwardly from the first lateral support member of the inner frame assembly, wherein the bar elements comprising the second set thereof extend between the bar element mounting elements on the first and second lateral support members of the inner frame assembly.

15. An apparatus of claim 14, wherein the inner frame assembly further includes an upper bracing member extending between the two side walls, above and to the rear of the second lateral support member of the inner frame assembly, and further includes flange plates connected to opposing ends of each of the two side walls and eccentric cams on the first and second drive shafts connected to the inner frame assembly flange plates, for movement of the inner frame assembly.

* * * * *